US009938864B2

(12) United States Patent
Noguchi et al.

(10) Patent No.: US 9,938,864 B2
(45) Date of Patent: Apr. 10, 2018

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Yuji Noguchi, Obu (JP); Takeo Asahi, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 73 days.

(21) Appl. No.: 15/118,197

(22) PCT Filed: Feb. 6, 2015

(86) PCT No.: PCT/JP2015/053321

§ 371 (c)(1),
(2) Date: Aug. 11, 2016

(87) PCT Pub. No.: WO2015/122359

PCT Pub. Date: Aug. 20, 2015

(65) Prior Publication Data

US 2017/0183987 A1 Jun. 29, 2017

(30) Foreign Application Priority Data

Feb. 14, 2014 (JP) ..... 2014-026726

(51) Int. Cl.
*F01L 1/46* (2006.01)
*F01L 1/356* (2006.01)
(Continued)

(52) U.S. Cl.
CPC ..... *F01L 1/356* (2013.01); *F01L 1/34* (2013.01); *F01L 1/46* (2013.01);
(Continued)

(58) Field of Classification Search
CPC ..... F01L 2001/3443; F01L 2001/34433; F01L 2001/3445; F01L 1/46
(Continued)

(56) References Cited

U.S. PATENT DOCUMENTS

2006/0137635 A1* 6/2006 Hayashi ..... F01L 1/022 123/90.17
2012/0060779 A1* 3/2012 Adachi ..... F01L 1/3442 123/90.15
(Continued)

FOREIGN PATENT DOCUMENTS

DE 10 2008 057 492 A1 5/2010
JP 11303612 A 11/1999
(Continued)

OTHER PUBLICATIONS

International Search Report (PCT/ISA/210) dated Apr. 28, 2015, by the Japanese Patent Office as the International Searching Authority for International Application No. PCT/JP2015/053321.
(Continued)

*Primary Examiner* — Jorge Leon, Jr.
(74) *Attorney, Agent, or Firm* — Buchanan Ingersoll & Rooney PC

(57) ABSTRACT

A valve opening and closing timing control apparatus includes a drive-side rotational member rotating synchronously with a crankshaft, a driven-side rotational member arranged at an inner side of the drive-side rotational member to be coaxial with and relatively rotatable to the drive-side rotational member, an adapter arranged between the driven-side rotational member and a camshaft in a state being coaxial with the driven-side rotational member, a fixing member arranged coaxially with the camshaft and integrally fixing the driven-side rotational member and the camshaft in a state where the adapter is disposed between the driven-side rotational member and the camshaft, and a phase change mechanism including a portion which is press-fitted to the fixing member in a coaxial manner, the driven-side rotational member being fixed to the adapter in a state where a clearance is provided between the driven-side rotational member and the adapter in a radial direction.

5 Claims, 2 Drawing Sheets

(51) Int. Cl.
*F01L 1/34* (2006.01)
*F01L 1/344* (2006.01)

(52) U.S. Cl.
CPC ..... *F01L 2001/3443* (2013.01); *F01L 2001/3445* (2013.01); *F01L 2001/34433* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 2013/0247855 | A1* | 9/2013 | Adachi ..... | F01L 1/3442 123/90.15 |
| 2013/0269638 | A1 | 10/2013 | Adachi et al. | |
| 2017/0183983 | A1 | 6/2017 | Noguchi et al. | |
| 2017/0183984 | A1 | 6/2017 | Asahi et al. | |

FOREIGN PATENT DOCUMENTS

| | | | |
|---|---|---|---|
| JP | 2001221017 | A | 8/2001 |
| JP | 2001-241306 | A | 9/2001 |
| JP | 2003113702 | A | 4/2003 |
| JP | 2012057578 | A | 3/2012 |
| JP | 2012-172559 | A | 9/2012 |

OTHER PUBLICATIONS

Written Opinion (PCT/ISA/237) dated Apr. 28, 2015, by the Japanese Patent Office as the International Searching Authority for International Application No. PCT/JP2015/053321.

Notification of Transmittal of Translation of the International Preliminary Report on Patentability (Forms PCT/IB/338 and PCT/IB/373) and the Written Opinion of the International Searching Authority (Form PCT/ISA/237) dated Aug. 16, 2016, by the International Bureau of WIPO in corresponding International Application No. PCT/JP2015/053321. (6 pgs).

* cited by examiner

VALVE OPENING AND CLOSING TIMING CONTROL APPARATUS

TECHNICAL FIELD

This invention relates to a valve opening and closing timing control apparatus mounted at an internal combustion engine for an automobile, for example, for controlling an opening and closing timing of an intake valve or an exhaust valve.

BACKGROUND ART

Patent documents 1 and 2 each disclose a valve opening and closing timing control apparatus including a drive-side rotational member, a driven-side rotational member, an adapter, a screw member and a phase change mechanism. The drive-side rotational member rotates synchronously with a crankshaft of an internal combustion engine. The driven-side rotational member is disposed at an inner side of the drive-side rotational member to be coaxial with the drive-side rotational member and to be relatively rotatable to the drive-side rotational member. The adapter is arranged between the driven-side rotational member and a camshaft for opening and closing a valve of the internal combustion engine to be coaxial with the driven-side rotational member. The screw member is arranged coaxially with the camshaft to integrally fasten and fix the driven-side rotational member and the camshaft in a state where the adapter is disposed between the driven-side rotational member and the camshaft. The phase change mechanism is configured to change a relative rotational phase between the drive-side rotational member and the driven-side rotational member.

DOCUMENT OF PRIOR ART

Patent Document

Patent document 1: DE102008057492A1
Patent document 2: JP2012-172559A

OVERVIEW OF INVENTION

Problem to be Solved by Invention

In a case where accuracy for matching a rotation axis of the driven-side rotational member and a rotation axis of the camshaft (i.e., coaxiality accuracy) is low, such low accuracy may cause a problem in an operation of the valve opening and closing timing control apparatus.

According to the valve opening and closing timing control apparatus in Patent document 1, the driven-side rotational member is assembled on the camshaft to be coaxial therewith via the adapter which is externally fitted to the screw member. Thus, the coaxiality accuracy of the driven-side rotational member and the camshaft depends on an assembly accuracy of the driven-side rotational member relative to the adapter and an assembly accuracy of the adapter relative to the screw member. The aforementioned assembly accuracies are correlated to each other, which may lead to difficulty in improving the coaxiality accuracy.

According to the valve opening and closing timing control apparatus in Patent document 2, the adapter is press-fitted to an inner circumferential side of the driven-side rotational member so that the adapter and the driven-side rotational member are integrally assembled on each other. The adapter and the driven-side rotational member which are integrally assembled on each other are fastened and fixed to the camshaft by means of the screw member so that the driven-side rotational member is assembled on the camshaft to be coaxial therewith. Therefore, the coaxiality accuracy of the driven-side rotational member and the camshaft depends on an assembly accuracy of the driven-side rotational member relative to the adapter and an assembly accuracy of the driven-side rotational member and the adapter, which are integrally assembled on each other, relative to the camshaft by means of the screw member. The aforementioned assembly accuracies are also correlated to each other, which may lead to difficulty in improving the coaxiality accuracy.

The present invention is made in view of the drawback mentioned above and it is desired to provide a valve opening and closing timing control apparatus which may improve a coaxiality accuracy of a driven-side rotational member and a camshaft.

Means for Solving Problem

A characteristic construction of a valve opening and closing timing control apparatus according to the present invention includes a drive-side rotational member rotating synchronously with a crankshaft of an internal combustion engine, a driven-side rotational member arranged at an inner side of the drive-side rotational member to be coaxial with the drive-side rotational member and to be relatively rotatable to the drive-side rotational member, an adapter arranged between the driven-side rotational member and a camshaft for opening and closing a valve of the internal combustion engine in a state being coaxial with the driven-side rotational member, a fixing member arranged coaxially with the camshaft and integrally fixing the driven-side rotational member and the camshaft in a state where the adapter is disposed between the driven-side rotational member and the camshaft, and a phase change mechanism configured to change a relative rotational phase between the drive-side rotational member and the driven-side rotational member, the driven-side rotational member including a portion which is press-fitted to the fixing member in a coaxial manner, the driven-side rotational member being fixed to the adapter in a state where a clearance is provided between the driven-side rotational member and the adapter in a radial direction.

In the valve opening and closing timing control apparatus including the aforementioned construction, the driven-side rotational member includes the portion which is press-fitted to the fixing member in a coaxial manner, the driven-side rotational member being fixed to the adapter in a state where the clearance is provided between the driven-side rotational member and the adapter in a radial direction. Therefore, a coaxiality accuracy of the driven-side rotational member and the camshaft may be specified on a basis of an assembly accuracy of the driven-side rotational member relative to the fixing member regardless of an assembly accuracy of the adapter relative to the fixing member or the camshaft. Thus, according to the valve opening and closing timing control apparatus including the aforementioned construction, the coaxiality accuracy of the driven-side rotational member and the camshaft may improve.

Another characteristic construction of the present invention is that a relative rotation restriction portion is provided across the driven-side rotational member and the adapter for restricting a relative rotation between the driven-side rotational member and the adapter.

According to the aforementioned construction, the relative rotation between the driven-side rotational member and the adapter may be restricted to stabilize a relative rotation between the adapter and the drive-side rotational member. In addition, it is convenient in a case where the driven-side rotational member and the adapter are assembled so that phases thereof match each other. That is, before the fixing member is inserted to the driven-side rotational member and the adapter, a relative movement of the driven-side rotational member and the adapter in the radial direction is not inhibited. Accordingly, assembly performance in a case where the fixing member is inserted to the driven-side rotational member and the adapter which are assembled while the clearance is disposed therebetween in the radial direction may improve. After the assembly of the fixing member, a relative rotational phase between the driven-side rotational member and the adapter may be specified at a predetermined phase.

Still another characteristic construction of the present invention is that the relative rotation restriction portion includes a pin member fixed to one of the driven-side rotational member and the adapter and a recess portion provided at the other of the driven-side rotational member and the adapter, the pin member being inserted to the recess portion along a longitudinal direction of the camshaft, and the recess portion is formed in an elongated bore so that a clearance is provided between the recess portion and the pin member along the radial direction.

According to the aforementioned construction, a simple construction where the pin member engages with the recess portion may restrict the relative rotation between the driven-side rotational member and the adapter.

Still another characteristic construction of the present invention is that the driven-side rotational member is made of aluminum material and the adapter is made of steel, and the pin member is fixed to the adapter and the recess portion is provided at the driven-side rotational member.

According to the aforementioned construction, because the pin member is fixed to the adapter made of steel, looseness in the fixing of the pin member relative to the adapter may be unlikely to occur. The relative rotation between the driven-side rotational member and the adapter may be restricted over a long time period to thereby accurately control the valve opening and closing timing.

Still another characteristic construction of the present invention is that the adapter is fitted to the fixing member.

According to the aforementioned construction, being separate from the driven-side rotational member, the adapter may be also assembled on the camshaft in a coaxial manner. A rotation accuracy of the drive-side rotational member supported at the adaptor may improve, thereby smoothly relatively rotate the drive-side rotational member and the driven-side rotational member.

MODE FOR CARRYING OUT THE INVENTION

Figure 1:
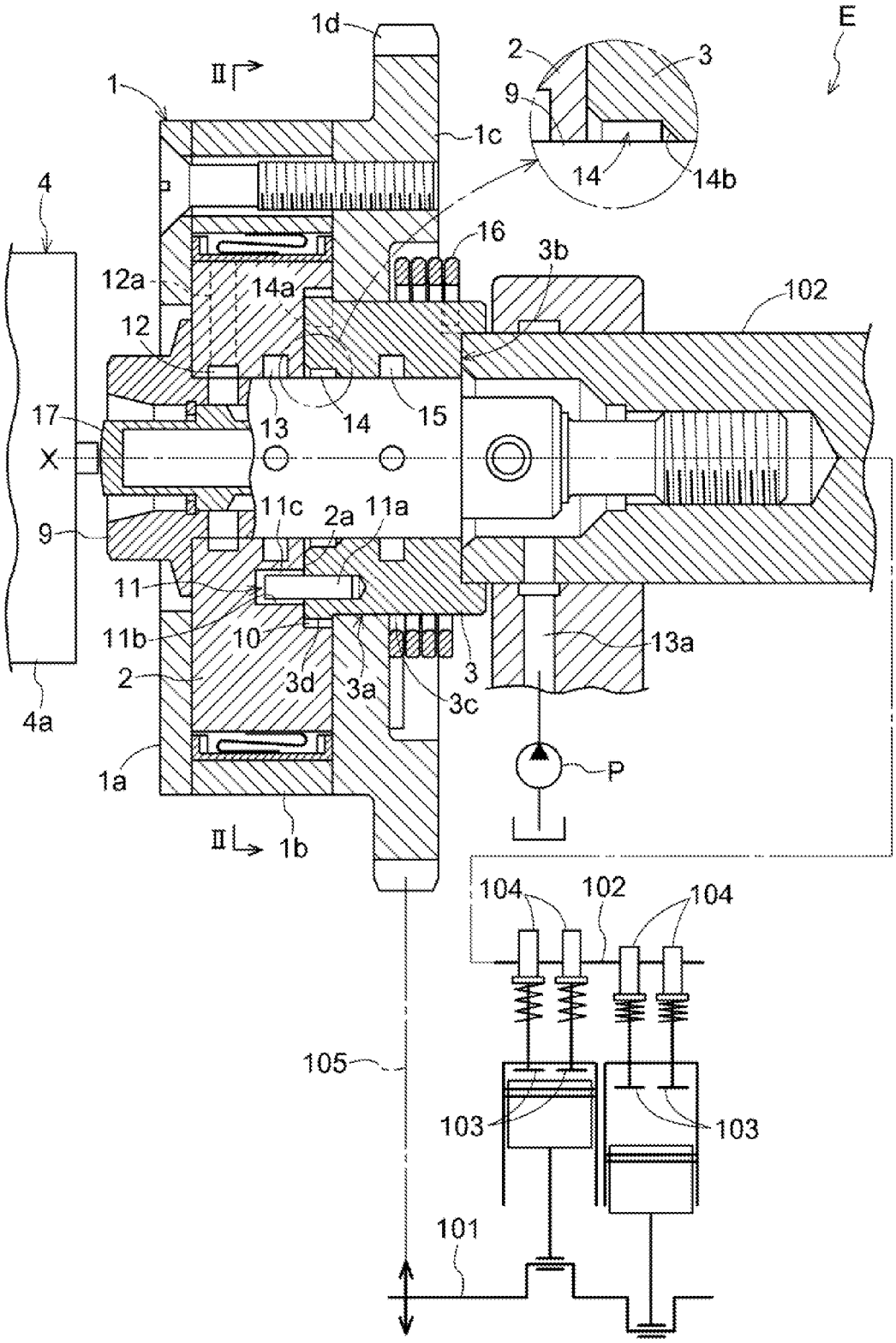
FIG. 1 is a cross-sectional view illustrating an entire construction of a valve opening and closing timing control apparatus.
Figure 2:
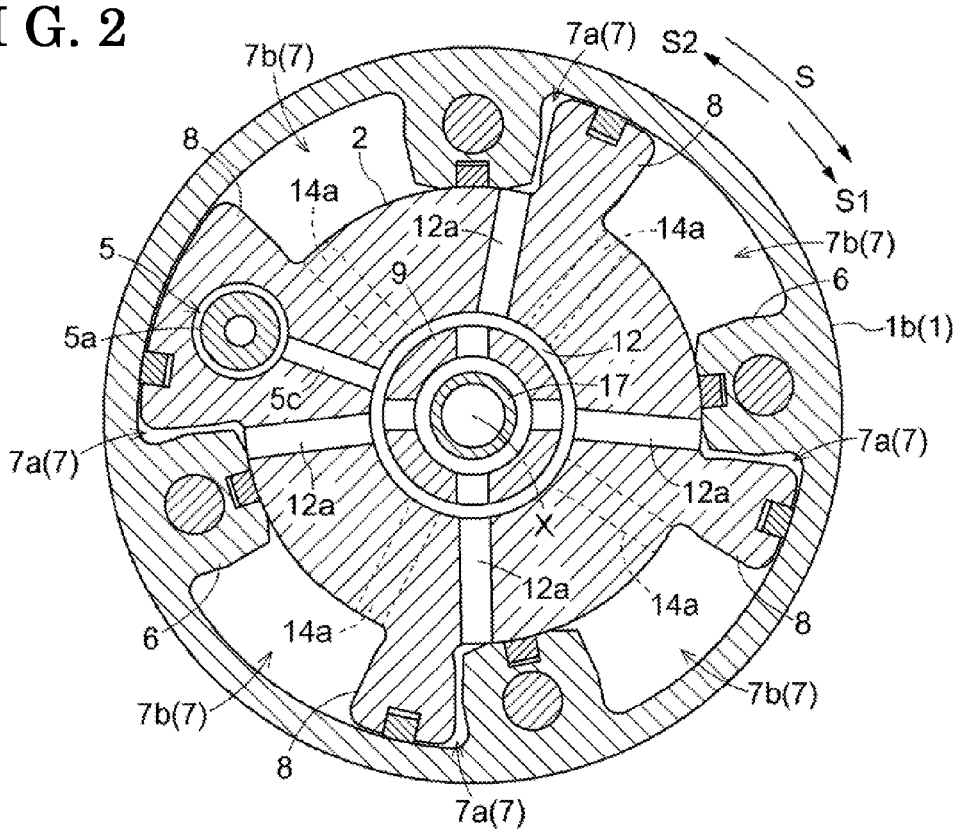
FIG. 2 is a cross-sectional view taken along a line II-II in FIG. 1.
Figure 3:
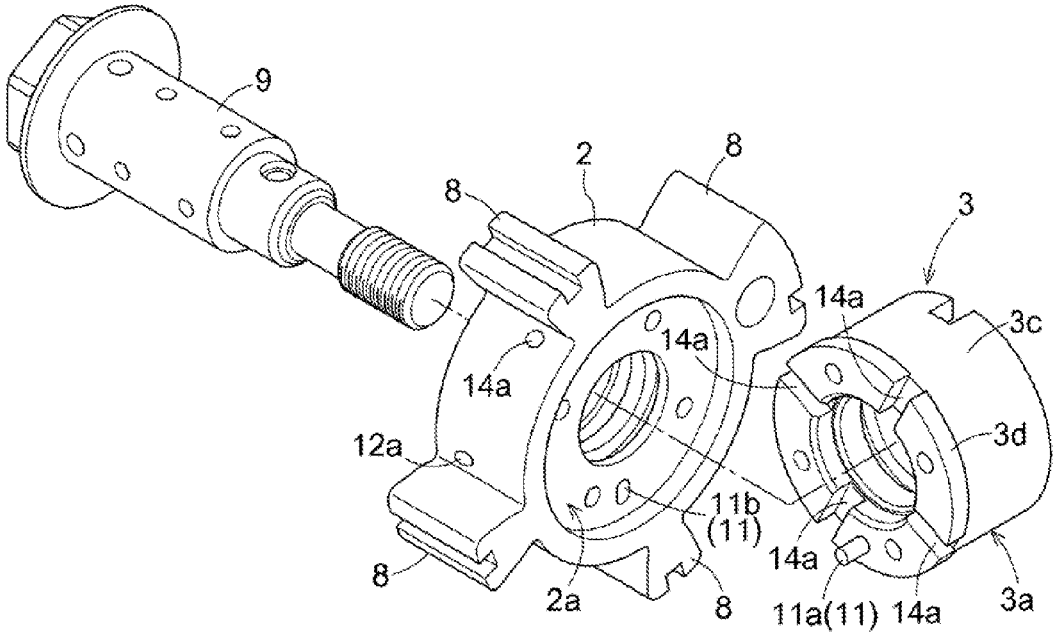
FIG. 3 is an exploded perspective view illustrating a construction of the valve opening and closing timing control apparatus.

An embodiment of the present invention is explained below with reference to the drawings. FIGS. 1 and 2 each illustrate a valve opening and closing timing control apparatus according to the present invention mounted at an engine for an automobile (an example of an internal combustion engine).

The valve opening and closing timing control apparatus includes a housing (drive-side rotational member) 1 made of steel, an inner rotor (driven-side rotational member) 2 made of aluminum alloy, an adapter 3 made of steel, a phase change mechanism 4 and a lock mechanism 5. The housing 1 rotates synchronously with a crankshaft 101 of an engine E. The inner rotor 2 is disposed at an inner side of the housing 1 to be coaxial with the housing 1 at an axis X and to be relatively rotatable to the housing 1. The inner rotor 2 rotates synchronously with a camshaft 102 for opening and closing valves of the engine. The adapter 3 in a cylindrical form is arranged between the inner rotor 2 and an end portion of the camshaft 102 to be coaxial with the inner rotor 2 at the axis X. The adapter 3 includes a support surface 3*a* at an outer peripheral side for supporting the housing 1 in a manner that the housing 1 is relatively rotatable. The phase change mechanism 4 is configured to change a relative rotational phase between the housing 1 and the inner rotor 2. The lock mechanism 5 locks the relative rotational phase between the housing 1 and the inner rotor 2 at a most retarded angle phase in a case where the engine is stopped.

The housing 1 is constituted by a front plate 1*a* disposed at an opposite side from a side where the camshaft 102 is arranged, an outer rotor 1*b* externally fitted to the inner rotor 2, and a rear plate 1*c* which integrally includes a timing sprocket 1*d* in a manner that the front plate 1*a*, the outer rotor 1*b* and the rear plate 1*c* are integrally assembled on one another.

Hydraulic chambers 7 are defined between the inner rotor 2 and the outer rotor 1*b* in a state where plural protruding portions 6 are provided at intervals around the rotation axis X at an inner circumferential side of the outer rotor 1*b*. Partition portions 8 are provided at respective portions of an outer peripheral portion of the inner rotor 2, the respective portions facing the hydraulic chambers 7, for dividing each of the hydraulic chambers 7 into an advanced angle chamber 7*a* and a retarded angle chamber 7*b*. The phase change mechanism 4 is provided so that the relative rotational phase is changeable by supplying oil (hydraulic fluid) to one of the advanced angle chamber 7*a* and the retarded angle chamber 7*b* and by discharging oil from the other of the advanced angle chamber 7*a* and the retarded angle chamber 7*b*.

The inner rotor 2 and the adapter 3 are assembled on the camshaft 102 so as to integrally rotate with the camshaft 102 in a state where an OCV bolt 9 which is internally fitted to each of the inner rotor 2 and the adapter 3 at the same axis X is screwed at the end portion of the camshaft 102. The OCV bolt 9 corresponds to a fixing member such as a screw member, for example, which is arranged coaxially with the camshaft 102 at the axis X and which is configured to integrally fasten and fix the inner rotor 2 and the camshaft 102 in a state where the adapter 3 is disposed between the inner rotor 2 and the camshaft 102.

The inner rotor 2 and the adapter 3 include respective portions which are press-fitted to the OCV bolt 9 in a coaxial manner. Each of the inner rotor 2 and the adapter 3 is externally fitted and fixed to an outer peripheral surface of the OCV bolt 9 in a manner being non-movable in a radial direction and movable in a direction of the axis X. Because the adapter 3 is assembled on the camshaft 102 to be coaxial therewith at the axis X while being externally fitted and fixed to the OCV bolt 9, a rotation accuracy of the housing 1 which is supported at the adapter 3 increases.

At this time, each of the inner rotor 2 and the adapter 3 may be externally fitted and fixed to the outer peripheral surface of the OCV bolt 9 in a manner being non-movable in the radial direction and the direction of the axis X. The end portion of the camshaft 102 is fitted to a recess surface portion 3*b* in a cylindrical form at an end portion of the adapter 3 so as to be coaxial with the recess surface portion 3*b* at the axis X.

The adapter 3 includes a small diameter portion 3*c* including the support surface 3*a* and a large diameter portion 3*d* functioning as a retainer against the rear plate 1*c*. The large diameter portion 3*d* is led to be positioned at a cylindrically-formed recess surface portion 2*a* provided at an end portion of the inner rotor 2 in a state where a clearance 10 is defined between an outer peripheral surface of the large diameter portion 3*d* and the recess surface portion 2*a* so that the inner rotor 2 is inhibited from making contact with the adapter 3 in a rotation radial direction.

A relative rotation restriction portion 11 is provided across the inner rotor 2 and the adapter 3 for restricting the relative rotation between the inner rotor 2 and the adapter 3. The relative rotation restriction portion 11 is constituted by a pin member 11*a* in a column form which is fixed to the adapter 3 in a state where a pin axis of the pin member 11*a* is in parallel to the rotation axis X and a recess portion 11*b* which is provided at the inner rotor 2 and with which the pin member 11*a* engages in a state where the pin member 11*a* is allowed to move only in the rotation radial direction. The recess portion 11*b* is formed in an elongated bore elongated along the rotation radial direction. In a case where the pin member 11*a* is inserted along a longitudinal direction of the camshaft 102 to be positioned within the recess portion 11*b*, a clearance 11*c* is formed along the radial direction between the recess portion 11*b* and the pin member 11*a*.

Accordingly, in a case where the OCV bolt 9 is inserted to the inner rotor 2 and the adapter 3, the inner rotor 2 and the adapter 3 move relative to each other in the rotation radial direction so that the inner rotor 2 and the adapter 3 are coaxial with each other to thereby improve assembly performance. A relative rotational phase between the inner rotor 2 and the adapter 3 may be specified at a predetermined phase after the OCV bolt 9 is assembled on the inner rotor 2 and the adapter 3.

A circumferential groove is provided at an inner peripheral surface of the inner rotor 2 for obtaining an advanced angle annular oil passage 12, which is in communication with the advanced angle chambers 7*a* via advanced angle oil passages 12*a*, between the inner peripheral surface of the inner rotor 2 and the outer peripheral surface of the OCV bolt 9. In addition, a circumferential groove is provided at the inner peripheral surface of the inner rotor 2 for obtaining a supply annular oil passage 13, which is in communication with a supply oil passage 13*a* connected to an oil pump P, between the inner peripheral surface of the inner rotor 2 and the outer peripheral surface of the OCV bolt 9.

A circumferential groove is provided at an inner peripheral surface of the adapter 3 for obtaining a retarded angle annular oil passage 14, which is in communication with the retarded angle chambers 7*b* via retarded angle oil passages 14*a*. In addition, a circumferential groove is provided at the inner peripheral surface of the adapter 3 for obtaining a relay annular oil passage 15, which connects between the supply oil passage 13*a* and the supply annular oil passage 13, between the inner peripheral surface of the adapter 3 and the outer peripheral surface of the OCV bolt 9.

The advanced angle oil passages 12*a* are provided to penetrate through the inner rotor 2 in the radial direction for the respective advanced angle chambers 7*a*. The retarded angle oil passages 14*a* are provided across the large diameter portion 3*d* of the adapter 3 and the inner rotor 2 for the respective retarded angle chambers 7*b*.

The retarded angle annular oil passage 14 is provided along a corner portion at an inner circumferential side of the adapter 3 so as to face the outer peripheral surface of the OCV bolt 9 and a bottom surface of the recess surface portion 2*a*. A groove side surface 14*b* which defines a portion of the retarded angle annular oil passage 14 facing the camshaft 102 is formed in a conical surface which comes closer to the camshaft 102 while coming closer to the OCV bolt 9.

Accordingly, even in a case where the axis of the adapter 3 is eccentric with the rotation axis X when the OCV bolt 9 is internally fitted to the inner rotor 2 and the adapter 3, the OCV bolt 9 is unlikely to engage with a circumferential groove portion serving as the retarded angle annular oil passage 14.

As illustrated in FIG. 1, the camshaft 102 is a rotation shaft of cams 104 for opening and closing intake valves 103. The camshaft 102 rotates synchronously with the OCV bolt 9, the inner rotor 2 and the adapter 3. The camshaft 102 is rotatably supported at a cylinder head of the engine not illustrated.

In a case where the crankshaft 101 is driven to rotate, a rotation power of the crankshaft 101 is transmitted to the timing sprocket 1*d* via a power transmission member 105. The housing 1 is driven to rotate in a rotation direction S as illustrated in FIG. 2 accordingly. With the rotation drive of the housing 1, the inner rotor 2 is then driven to rotate in the rotation direction S to thereby rotate the camshaft 102. The cams 104 provided at the camshaft 102 press down the intake valves 103 to open the valves. A torsion coil spring 16 for biasing a rotation phase of the inner rotor 2 relative to the housing 1 in an advanced angle direction S1 is disposed between the inner rotor 2 and the rear plate 1*c*.

As illustrated in FIG. 2, the advanced angle direction S1 corresponds to a direction where a volume of each of the advanced angle chambers 7*a* increases. A retarded angle direction S2 corresponds to a direction where a volume of each of the retarded angle chambers 7*b* increases. The relative rotational phase obtained when the volume of the advanced angle chamber 7*a* becomes maximum is a most advanced angle phase. In addition, the relative rotational phase obtained when the volume of the retarded angle chamber 7*b* becomes maximum is a most retarded angle phase.

The phase change mechanism 4 moves a spool 17 mounted at an inner side of the OCV bolt 9 by an operation of a solenoid 4*a* for controlling supply and discharge of oil, and interruption of the supply and discharge of oil relative to the advanced angle chambers 7*a* and the retarded angle chambers 7*b*. The relative rotational phase is changed to the advanced angle direction or to the retarded angle direction, or is retained at a desired relative rotational phase.

The lock mechanism 5 includes a lock member 5*a* mounted at the inner rotor 2 so as to protrude and retract in a direction of the rotation axis X towards the housing 1, a lock recess portion provided at the housing 1 and a lock release oil passage 5*c* supplying oil for lock release. The lock release oil passage 5*c* is connected to the advanced angle annular oil passage 12.

The lock mechanism 5 locks the relative rotational phase between the housing 1 and the inner rotor 2 at the most retarded angle phase by fitting the lock member 5*a* in the lock recess portion 5*b* by a biasing force of a biasing member such as a spring, for example, when the engine is stopped. Then, in a case where oil is supplied to the advanced angle annular oil passage 12 so as to change the relative rotational phase to the advanced angle direction S1, the oil is supplied to the lock recess portion 5*b* through the lock release oil passage 5*c* so that the lock member 5*a* is retracted from the lock recess portion 5*b* against the biasing force. The lock is released accordingly.

Other Embodiments

1. The valve opening and closing timing control apparatus according to the present invention may include an adapter which is secured so as not to make contact with a fixing member.
2. The valve opening and closing timing control apparatus according to the present invention may control an opening and closing timing of an exhaust valve mounted at the internal combustion engine.

INDUSTRIAL AVAILABILITY

The present invention is applicable to a valve opening and closing timing control apparatus for an internal combustion engine of an automobile and other various applications.

EXPLANATION OF REFERENCE NUMERALS

1 housing (drive-side rotational member)
2 inner rotor (driven-side rotational member)
3 adapter
4 phase change mechanism
9 fixing member (OCV bolt)
10 clearance
11 relative rotation restriction portion
11*a* pin member
11*b* engagement portion
101 crankshaft
102 camshaft
X axis

The invention claimed is:

1. A valve opening and closing timing control apparatus comprising:

a drive-side rotational member rotating synchronously with a crankshaft of an internal combustion engine;

a driven-side rotational member arranged at an inner side of the drive-side rotational member to be coaxial with the drive-side rotational member and to be relatively rotatable to the drive-side rotational member;

an adapter arranged between the driven-side rotational member and a camshaft for opening and closing a valve of the internal combustion engine in a state being coaxial with the driven-side rotational member;

a fixing member arranged coaxially with the camshaft and integrally fixing the driven-side rotational member and the camshaft in a state where the adapter is disposed between the driven-side rotational member and the camshaft; and a phase change mechanism configured to change a relative rotational phase between the drive-side rotational member and the driven-side rotational member, the driven-side rotational member including a portion which is press-fitted to the fixing member in a coaxial manner, the driven-side rotational member being fixed to the adapter in a state where an annular clearance is provided between the driven-side rotational member and the adapter in a radial direction.

2. The valve opening and closing timing control apparatus according to claim 1, further comprising a relative rotation restriction portion provided across the driven-side rotational member and the adapter for restricting a relative rotation between the driven-side rotational member and the adapter.

3. The valve opening and closing timing control apparatus according to claim 2, wherein the relative rotation restriction portion includes a pin member fixed to one of the driven-side rotational member and the adapter and a recess portion provided at the other of the driven-side rotational member and the adapter, the pin member being inserted to the recess portion along a longitudinal direction of the camshaft, the recess portion is formed in an elongated bore so that a clearance is provided between the recess portion and the pin member along the radial direction.

4. The valve opening and closing timing control apparatus according to claim 3, wherein the driven-side rotational member is made of aluminum material and the adapter is made of steel, the pin member is fixed to the adapter and the recess portion is provided at the driven-side rotational member.

5. The valve opening and closing timing control apparatus according to claim 1, wherein the adapter is fitted to the fixing member.

* * * * *